US006888081B2

(12) United States Patent
Friedrich et al.

(10) Patent No.: US 6,888,081 B2
(45) Date of Patent: May 3, 2005

(54) SAFETY CONTACT MAT

(75) Inventors: Helmut Friedrich, Lippstadt (DE); Paul Meyer, Büren (DE)

(73) Assignee: ASO GmbH Antriebs-und Steuerungstechnik, Salzkotten (DE)

( * ) Notice: Subject to any disclaimer, the term of this patent is extended or adjusted under 35 U.S.C. 154(b) by 0 days.

(21) Appl. No.: 10/479,825

(22) PCT Filed: Jun. 14, 2002

(86) PCT No.: PCT/DE02/02177

§ 371 (c)(1),
(2), (4) Date: Dec. 4, 2003

(87) PCT Pub. No.: WO02/103647

PCT Pub. Date: Dec. 27, 2002

(65) Prior Publication Data

US 2004/0154908 A1 Aug. 12, 2004

(30) Foreign Application Priority Data

Jun. 19, 2001 (DE) ..... 101 29 183

(51) Int. Cl.[7] ..... H01H 1/10
(52) U.S. Cl. ..... 200/517; 200/86 R; 338/47
(58) Field of Search ..... 200/517, 86 R, 200/86 A, 85 C, 61.41, 61.43; 338/47, 99, 114

(56) References Cited

U.S. PATENT DOCUMENTS 3,617,666 A * 11/1971 Braue ..... 200/86 R
4,268,815 A * 5/1981 Eventoff et al. ..... 338/69
4,617,433 A * 10/1986 Hoshikawa et al. ..... 200/86 R
4,623,766 A * 11/1986 Utagawa et al. ..... 200/85 R
4,659,873 A * 4/1987 Gibson et al. ..... 178/18.05
4,729,809 A * 3/1988 Dery et al. ..... 156/306.6
4,876,419 A 10/1989 Lodini
5,047,602 A * 9/1991 Lipka ..... 200/86 R
5,120,980 A * 6/1992 Fontaine ..... 307/10.1
5,192,837 A * 3/1993 Chardon ..... 200/61.41
5,228,562 A * 7/1993 Burk ..... 200/512
5,505,757 A * 4/1996 Ishii ..... 55/523
5,693,921 A * 12/1997 Miller et al. ..... 200/5 A
5,780,793 A * 7/1998 Buchholz et al. ..... 200/61.44
5,828,289 A 10/1998 Burgess
6,172,315 B1 * 1/2001 Miller et al. ..... 200/61.73

FOREIGN PATENT DOCUMENTS

EP 0 293 734 12/1988

* cited by examiner

*Primary Examiner*—K. Lee
(74) *Attorney, Agent, or Firm*—Cohen, Pontani, Lieberman & Pavane

(57) ABSTRACT

A safety contact mat has an upper mat half and a lower mat half with respective mutually facing spaced apart conductive layers, which are to be brought into contact in order to close an electrical contact. At least one of the mat halves is formed by a flat coextrudate of a non-conductive elastomer, a conductive elastomer as the conductive layer, and of a conductive woven material enclosed between the elastomers.

21 Claims, 5 Drawing Sheets

SAFETY CONTACT MAT

PRIORITY CLAIM

This is a U.S. national stage of application No. PCT/DE02/02177, filed on 14 Jun. 2002. Priority is claimed on that application and on the following application: Country: Germany, Application No.: 101 29 183.3, Filed: 19 Jun. 2001.

BACKGROUND OF THE INVENTION

1. Field of the Invention

The invention concerns a safety contact mat, which has an upper and a lower mat half with two opposing conductive layers spaced some distance apart, which are to be brought into contact to close an electrical contact.

2. Description of the Related Art

Safety contact mats are well known and reliable. They are regularly used for the protection of output areas of machinery or similar hazardous areas that must not be walked on or driven on by persons or vehicles, etc., for safety reasons. Under a weight load, a safety contact mat of this type will, for example, close an electrical circuit, by which an emergency stop of the machinery is effected to prevent injury or damage.

To this end, safety contact mats of this type are constructed of several layers, with a bottom layer, a first conductive circuit layer applied above it, and then a second conductive circuit layer, and above that a nonconductive running layer, which is usually textured.

To meet the safety requirements, a safety contact mat must have a high degree of circuit reliability, which in practice is usually ensured by high design expense and the use of high-grade materials.

In addition to the production of safety contact mats with standard dimensions, customers often require custom manufacturing, which is associated with higher costs, since even a safety contact mat with special dimensions must be constructed at the factory.

SUMMARY OF THE INVENTION

Proceeding from this technical background, the objective of the invention is to develop a safety contact mat, which still has a simple structural design and yet guarantees high circuit reliability and can be easily made available in almost any desired dimensions.

According to the invention, one mat half consists of a flat coextrudate of a nonconductive elastomer, a conductive elastomer, and a conductive woven material enclosed by the elastomers.

By this simple means, a circuit layer is made available, which has a uniform electrical resistance over its area due to the conductive woven material. Even if the conductive elastomer happens to have a comparatively high resistance, the conductive woven material further ensures that the electrical contact is reliably closed, since the conductive woven material guarantees a uniform potential distribution over the area of the circuit layer. Due to the production as a flat coextrudate, the conductive elastomer is directly connected with the nonconductive elastomer through the conductive woven material. A reliable and durable, but also very flexible connection of these three layers is thus guaranteed.

Furthermore, the flat coextrudate with the properties described above can be rolled up due to its flexibility and is thus easy to store without it being necessary to preestablish certain dimensions, as in the case of preproduced plates.

The nonconductive elastomer can form a running surface or a base layer with an antislip surface structure in the usual way.

Both the lower mat half and the upper mat half are preferably formed by a flat coextrudate of this type, so that these mat halves are similarly designed. Different designs for the upper and lower mat halves are avoided in this way, and this greatly simplifies the construction of the safety contact mat compared to the previously known mats.

Furthermore, the mat can be turned over without any loss of function. This doubles the service life of the safety contact mat of the invention compared to state-of-the-art safety contact mats, which must be replaced when a running surface becomes damaged due to the attendant safety risks.

Since the flat coextrudate is available as meter ware, i.e., as continuous extrudate, it can be cut to almost any desired predetermined dimensions for the safety contact mat. Any desired dimensions of the safety contact mat of the invention can thus be realized in a simple way.

This is further facilitated by the fact that a width of the flat coextrudate of more than 1.00 m is provided, and especially about 1.5 m.

The thickness of the flat coextrudate is preferably less than 10 mm, and more preferably about 6 mm. Of this amount, the running layer, for example, an NBR (nitrile butadiene) rubber, preferably accounts for about 4 mm, while the circuit layer, which is made, for example, of a TPE (thermoplastic elastome), accounts for about 2 mm, with the conductive woven material enclosed between them. In this way, it is basically possible to construct safety contact mats with an extremely small thickness. For example, it is easily possible to design and construct safety contact mats with thicknesses less than 15 mm, and especially about 10 mm. However, the thickness of a flat coextrudate is also regularly determined by the future load.

In a design modification, it is possible for the conductive woven material to be a metal fabric, especially one made of high-grade steel. This measure provides not only suitable flexibility, but also mechanical stability, and high-grade steel is also sufficiently electrically conductive.

In addition to space the opposing circuit layers, individual, symmetrically mounted spacers made of a nonconductive plastic are provided in the safety contact mat of the invention. These spacers are regularly formed by sections that extend over an area and predetermine the spacing of the circuit layers. These sections have spikes that project from the top and bottom and that can be inserted into the upper or lower mat half in such a way that they cannot be removed again. By providing individual spacers, it is also possible to construct a safety contact mat with zones of different sensitivity, which can be largely predetermined by the number and spacing of the spacers.

In a further modification, one layer of the flat coextrudate can be made of a TPE. Terpolymers can also be adjusted to be electrically conductive and nonconductive. Here they offer the advantage that the outer edges of the mat half can be easily welded together, for example, by ultrasonic welding. Naturally, adhesive bonding is alternatively or additionally possible. This measure ensures that water, dirt, and the like cannot penetrate between the mat halves, and this provides high circuit reliability of the safety contact mat of the invention.

Alternatively or additionally, the outer edges of the mat halves may also be framed by a profile, which is designed with a C-shape or U-shape for this purpose. It is also conceivable for the profile and the mat halves to interlock and especially for the free legs of the profile to be provided with suitable undercuts on the upper and lower side of the mat, so that it is virtually impossible to pull the profile off transversely to its longitudinal direction.

Furthermore, to seal the outer edges of the mat halves, it is advantageous for the profile, the mat halves, and a spacer strip that runs around the edge of the mat to be bonded together with adhesive. Providing the spacer strip around the mat ensures that, even near the edge of the profile, when a load is present on the safety contact mat, the circuit surfaces make contact. In addition, this provides a high degree of protection against the penetration of water, dust, and the like through the profile around the edge and the adhesive bond and/or weld.

In a further design modification, the profile can be provided with a ramp-like design. This provides a simple means for the rollers of a cart or the like to run onto the safety contact mat.

The profile may be provided with a cable conduit, which can be used to hold the service lines of the safety contact mat or to run other cables.

In a preferred embodiment, the profile, especially a C-shaped or U-shaped profile, is made of NBR rubber, but other materials, especially EPDM (ethylene-propylene-diene monomer) or other rubbers are possible. An NBR rubber has the advantage of high resistance to oils, while TPE, for example, can be readily dyed, so that one edge of the safety contact mat can be produced in a signal color. Alternatively, the profile can be made of a metal, for example, an aluminum, especially if it is designed with a ramp.

A connecting device on the narrow side with connecting pins located one above the other can be provided for the electrical contacting of the safety contact mat. The vertical distance between the pins is set in such a way that it approximately corresponds to the vertical distance separating the two layers of conductive woven material. In particular, this measure ensures that the connecting pins will actually contact the electrically conducting woven material. This ensures a low electrical contact resistance. A connecting device of this type also allows connection anywhere along the edge.

Alternatively, a connecting device that can be placed between the conductive layers can be provided, which has vertically directed connecting pins on a nonconductive mounting plate, whose thickness corresponds to the distance separating the conductive layers in the unloaded state. A connecting device of this type also acts as a spacer. Naturally, the length of the connecting pins must be selected smaller than the thickness of the sheets of material lying above and below them. A connecting device of this type basically can also be installed at any desired place between the sheet halves.

Advantageously, it is also possible to make available a construction kit for a safety contact mat, which, in particular, has one or more of the features explained above. This construction kit includes at least one flat coextrudate of a nonconductive elastomer, a conductive elastomer, and a conductive woven material enclosed between the elastomers, as well as at least one connecting device, a spacer strip, and individual spacers.

For the first time, this gives the user the opportunity to make a safety contact mat to his/her individual specifications. To do this, it is only necessary to cut two pieces of the desired geometry from the flat coextrudate, mount the spacer strip on the edge, install a connecting device once, and place the individual spacers in suitable locations. When the edge has been sealed, for example, by adhesive bonding, the safety contact mat is finished.

In addition, in a preferred embodiment, an edge profile may be supplied with the construction kit to guarantee reliable sealing of the edge of the safety contact mat.

The invention is explained in greater detail below with reference to the drawings, in which only examples of embodiments are shown.

DETAILED DESCRIPTION OF THE PRESENTLY PREFERRED EMBODIMENTS

Figure 1:
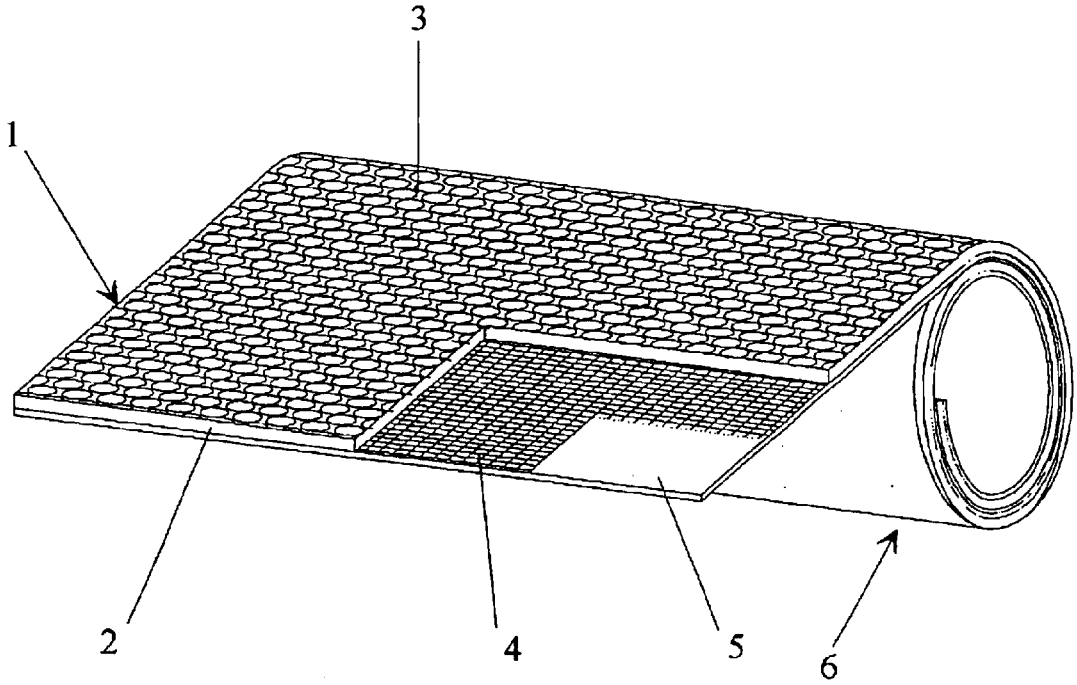
FIG. 1 shows a partially cutaway view of a flat coextrudate.

FIG. 1 shows a flat coextrudate 1, whose uppermost, nonconductive layer is textured by standard means as a running layer 2 with an antislip surface 3.

An electrically conductive woven material 4 is provided beneath the running layer. This electrically conductive woven material preferably consists of a metal, especially a high-grade steel.

The running layer 2 is connected with an electrically conductive circuit layer 5 lying beneath it through the woven material 4.

The running layer 2, the woven material 4, and the circuit layer 5, which consist of different materials throughout, are extruded together, and the flat coextrudate obtained in this way is sufficiently elastic that it can easily be rolled into a roll 6, shipped, and stored. A further advantage in this regard is that the roll width corresponds to the working width.

Figure 2:
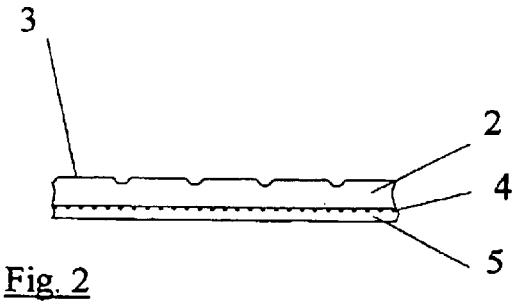
FIG. 2 shows a cross section through the flat coextrudate of FIG. 1.

The flat coextrudate has an extremely small thickness. For example, the section through the flat coextrudate 1 shown in FIG. 2 is shown in a scale of approximately 1:1. It can be derived from this drawing that the total thickness of the flat coextrudate 1 is only about 6 mm. Of this amount, the running layer 2, which consists, for example, of an NBR rubber, accounts for 4 mm, while the circuit layer 5 accounts for about 2 mm. The woven material 4 is embedded between the circuit layer 5 and the running layer 2.

Other dimensions are perfectly possible. Of course, it should be noted that the distance from the free surface of the circuit layer 5 to the conductive fabric 4 should not be selected to be too great, so that a sufficient electric current can reliably flow.

Figure 4:
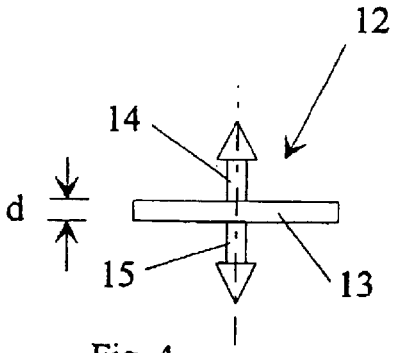
FIG. 4 shows a side view of a spacer.
Figure 3:
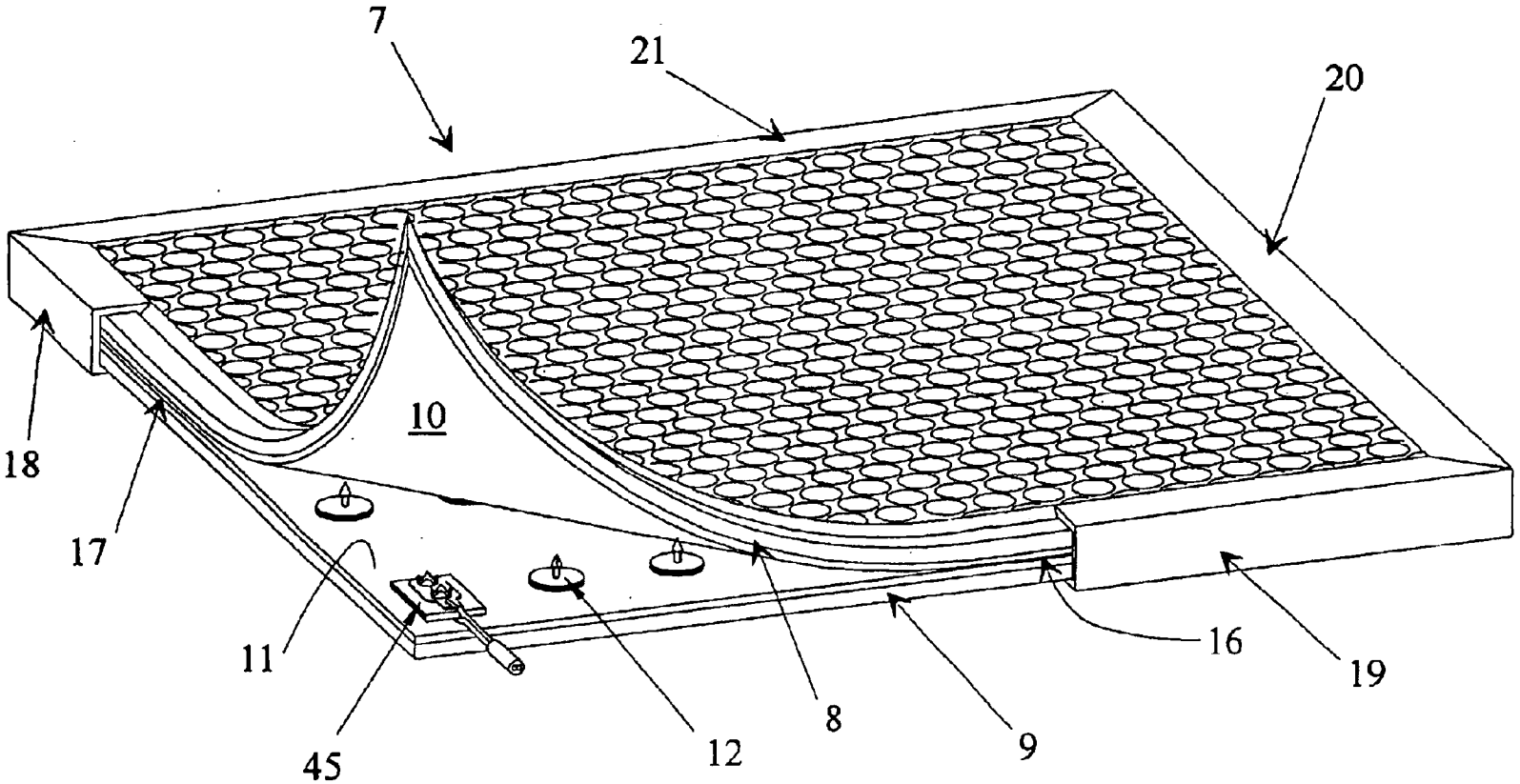
FIG. 3 shows a fabricated safety contact mat in accordance with the invention with the top half of the mat partly turned up.

FIG. 3 shows the design of a safety contact mat 7 of the invention. An upper mat half 8 and a lower mat half 9 are made in the same way from a flat coextrudate 1. The opposing conductive circuit layers 10, 11 are maintained a certain distance apart by individual, symmetrically designed spacers 12, which are made of a nonconductive plastic (see FIG. 4).

These spacers 12 have a middle section that extends over an area 13, shown here, for example, in the form of a circular disk, whose thickness d determines the distance separating the circuit surfaces 10, 11.

In addition, the spacers 12 are symmetrically designed here and have spikes 14, 15 projecting above and below the section 13. The height of these spikes above the section 13 is designed to be smaller than the thickness of a mat half 8, 9 formed from a flat coextrudate 1. If the spikes 14, 15 penetrate the mat halves 8, 9, their geometry causes them to lock in place, so that they cannot be pulled out.

Since the flat coextrudate 1 for the similar mat halves 8, 9 is available in the form of meter ware with almost any desired dimensions, the dimensions of the safety contact mat 7 can also be varied in almost any desired way by simple cutting.

Figure 9:
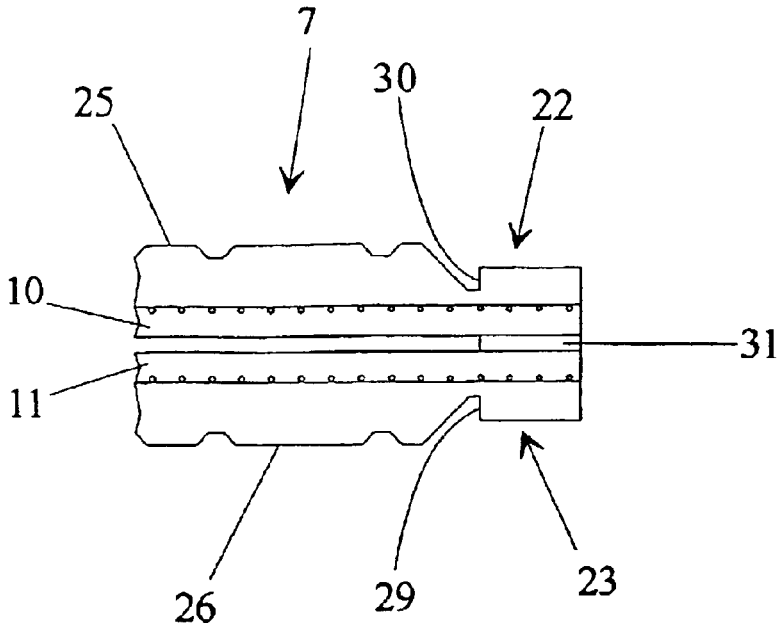
FIG. 9 shows the edge profile of a safety contact mat.
Figure 10:
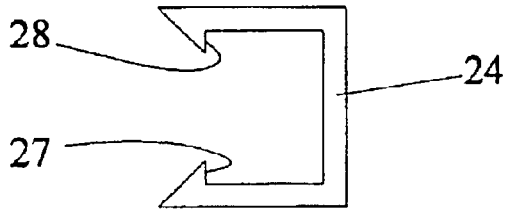
FIG. 10 shows a profile for enclosing the edge of a safety contact mat.
Figure 11:
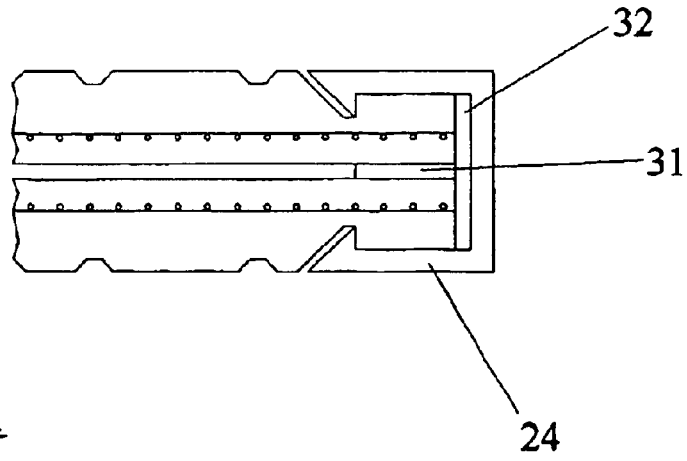
FIG. 11 shows the profile of FIG. 10 attached to a safety contact mat.

FIG. 3 also shows the profiles 18 to 21 that enclose the edges 16, 17 of the safety contact mat 7 (cf. also FIGS. 9 to 11).

FIG. 9 shows edge-side profiling 22, 23 in a front view, which is coordinated with the cross section of profile 24 in FIG. 10. Due to the profiling 22, 23, it should be noted first that the profile 24 is not elevated above the surfaces 25, 26 of the safety contact mat 7. The profile 24, which is essentially U-shaped, has locking catches 27, 28, which engage corresponding locking recesses 29, 30 in the surface 25, 26. The profile 24 is thus prevented from being simply pulled off transversely with respect to its longitudinal direction.

In the edge region of the safety contact mat 7, the conductive layers 10 and 11 are separated by a peripheral nonconductive spacer strip 31. The spacer strip 31 is adhesively bonded and/or welded with the conductive layers 10, 11 and thus not only has a spacing function, but also serves to tightly seal the open space between the conductive layers 10, 11. If, in particular, the conductive layers 10, 11 are made of a TPE, and the spacer strip 31 is made of the same material, ultrasonic welding along the edges of these layers is also possible.

It is conceivable for the profile 24 merely to be slid on or clipped on. However, the use of an adhesive 32 and/or a sealant on the narrow side is preferred (see FIG. 11). This ensures an extremely reliable seal of the edges 16, 17 of the safety mat 7.

The profile shown in FIG. 10 may consist of almost any desired material. Plastics or metals are equally suitable. A profile made of NBR rubber has proven especially effective, since it not only has excellent oil-resistant properties, but also allows the possibility, for example, of dyeing the material with signal colors.

Figure 12:
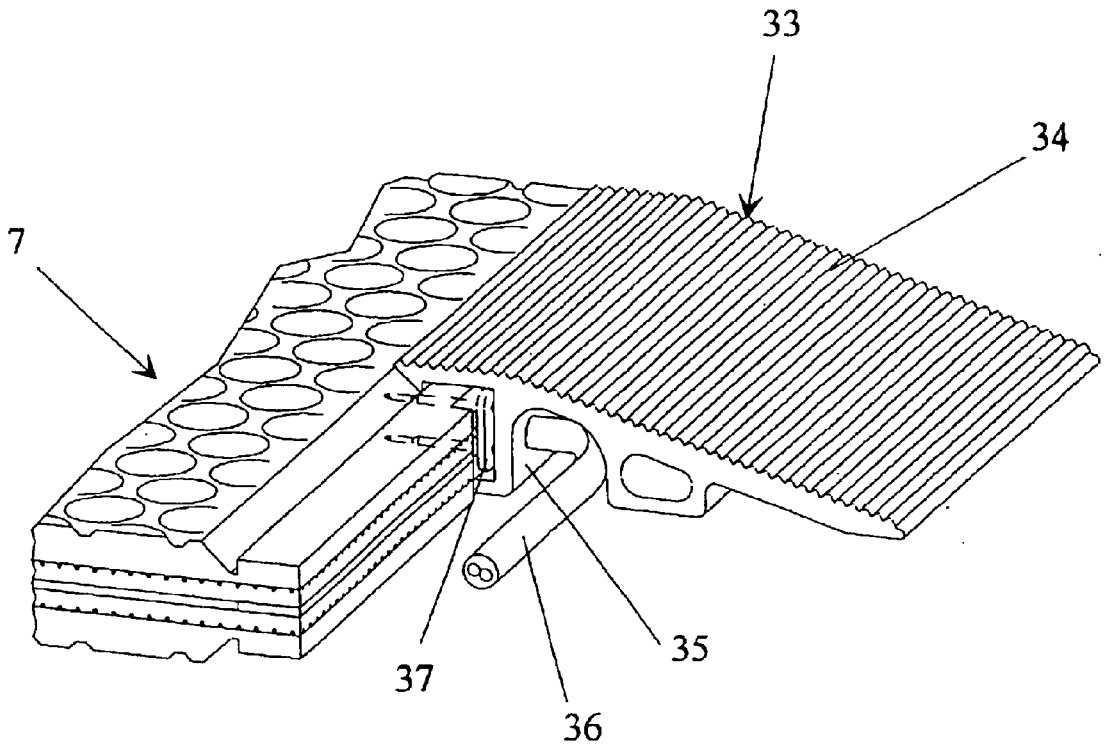
FIG. 12 shows a second embodiment of a profile.

FIG. 12 shows another embodiment of the profile. In this case, a profile 33 is provided with a ramp 34 and thus has the ramp-like design referred to earlier. It is connected to the safety contact mat 7 in the manner explained earlier.

A special feature of the profile 33 is a cable conduit 35. In this way, a connecting cable 36 can be run to any desired place in the peripheral region of the safety contact mat 7 to establish contact by means of a connecting device 37.

Especially a profile 33 with a ramp-like design can be made of a metal, for example, aluminum, to allow greater loads.

Figure 7:
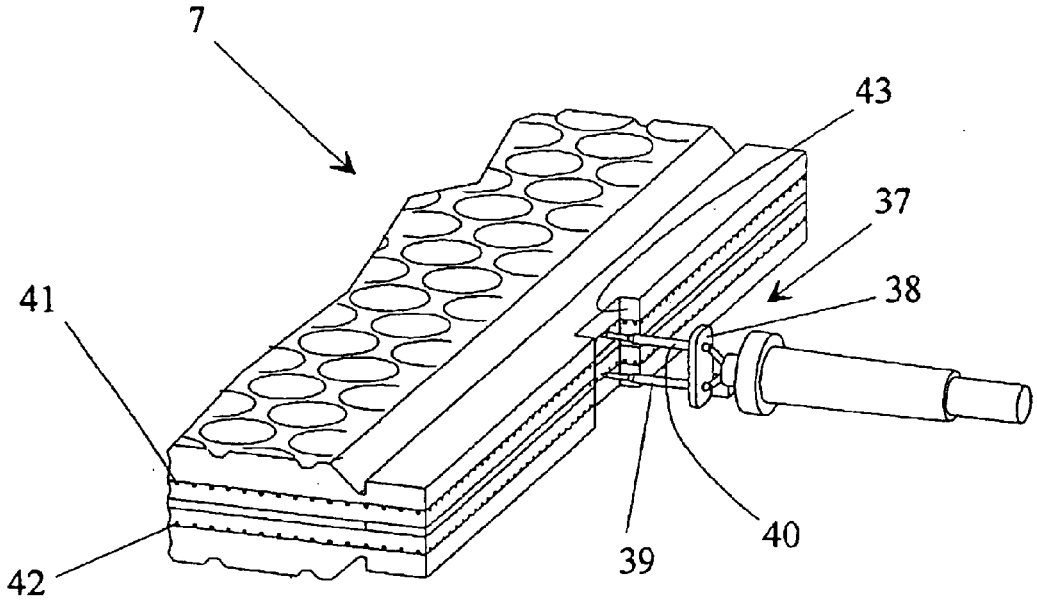
FIG. 7 shows a second embodiment of a connecting device set in position at the safety contact mat.
Figure 8:
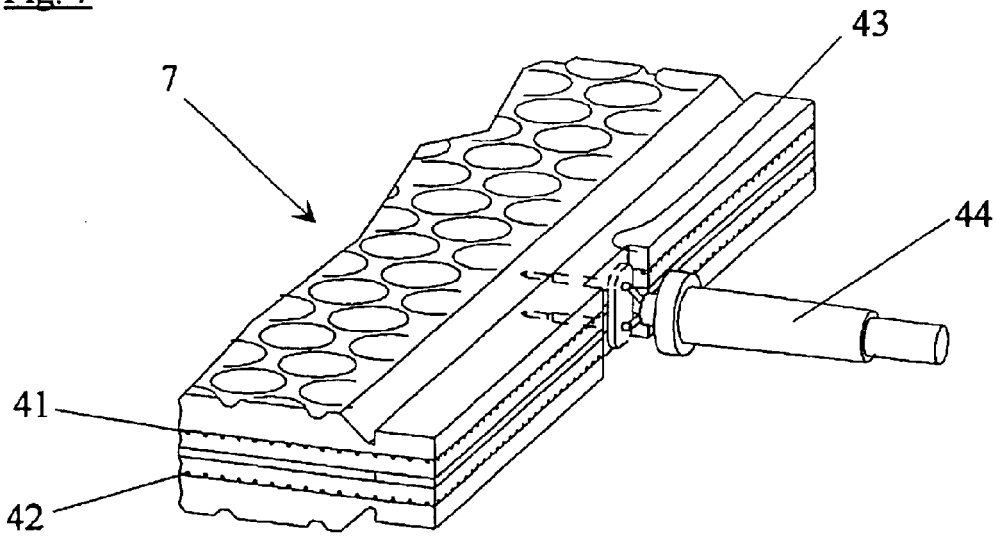
FIG. 8 shows the connecting device of FIG. 7 inserted in a safety contact mat.

The connecting device 37 (see also FIGS. 7 and 8) is connected to a safety contact mat 7 at the edge. It has a mounting plate 38 made of a nonconductive material, on which two horizontally oriented connecting pins 39, 40 are arranged one above the other. The vertical distance between them is dimensioned in such a way that it approximately corresponds to the vertical distance separating the layers of conductive woven material 41, 42, so that there is preferably direct contact with the layers of woven material 41, 42.

It is advantageous to place the support plate 38 in a recess 43 in the narrow side of the safety contact mat 7, so that a profile 33 can be attached without any problems (see FIG. 12).

A cable bushing 44 may possibly also be provided for traction relief and leading through profiles 33 or 24.

Figure 5:
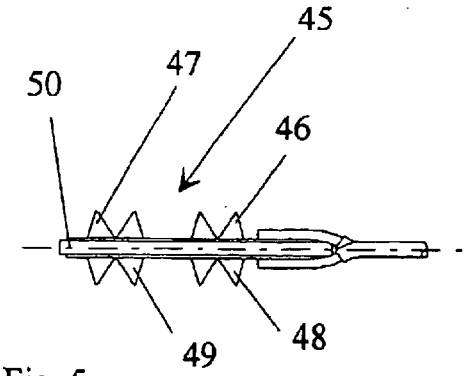
FIG. 5 shows a side view of a connecting device.
Figure 6:
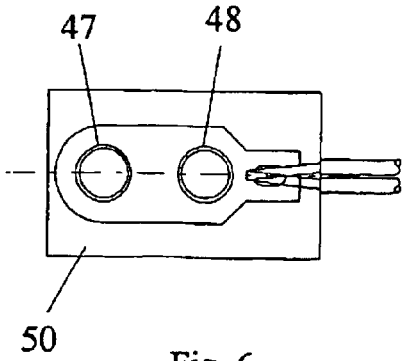
FIG. 6 shows a top view of the connecting device of FIG. 5.

FIG. 3 and FIGS. 5 and 6 show another connecting device 45, which can be inserted between the conductive layers 10, 11. To this end, vertically oriented connecting pins 46 to 49 in the form of crown contacts are arranged on a nonconductive mounting plate 50. The thickness of the mounting plate 50 corresponds to the distance between the conductive layers 10, 11 in the unloaded state, so that the mounting plate also serves as a spacer.

Advantageously, both connecting devices 37 and 45 can be connected at almost any desired place between or along the edge.

The comparatively simple design of the safety contact mat 7 of the invention makes it possible to provide a user with a flat coextrudate, at least one connecting device, a spacer strip, and individual spacers in the form of a construction kit, so that he can make a safety contact mat to his own individual specifications. If necessary, a construction kit of this type can be completed with an edge profile.

What is claimed is:

1. A safety contact mat comprising an upper mat half and a lower mat half, each mat half having a conductive circuit layer, said circuit layers being in mutually facing spaced relationship so that said layers can be brought into electrical contact, at least one of said mat halves consisting of a flat coextrudate comprising a nonconductive elastomer, a conductive elastomer as said conductive circuit layer, and a conductive woven material enclosed between said nonconductive elastomer and said conductive elastomer.

2. A safety contact mat as in claim 1 wherein each of said mat halves consists of said flat coextrudate.

3. A safety contact mat as in claim 2 further comprising a connecting device having parallel connecting pins spaced for contacting the conductive woven material in respective said mat halves.

4. A safety contact mat as in claim 2 further comprising a connecting device having a nonconductive mounting plate received between conductive circuit layers of respective said mat halves, said device further having a pair of opposed connecting pins which penetrate the conductive circuit layers of respective mat halves.

5. A safety contact mat as in claim 1 wherein said flat coextrudate is available as meter ware.

6. A safety contact mat as in claim 1 wherein said flat coextrudate has a width of more than 1.0 m.

7. A safety contact mat as in claim 1 wherein said flat coextrudate has a thickness of less than 10 mm.

8. A safety contact mat as in claim 1 wherein said conductive woven material is a metal fabric.

9. A safety contact mat as in claim 8 wherein said metal fabric is stainless steel.

10. A safety contact mat as in claim 1 further comprising symmetrically designed spacers situated between said conductive circuit layers, said spacers being made of dielectric material.

11. A safety contact mat as in claim 1 wherein said conductive elastomer is a thermoplastic elastomer.

12. A safety contact mat as in claim 1 wherein said mat halves have respective outer edges which are adhesively bonded together.

13. A safety contact mat as in claim 1 wherein said mat halves have respective outer edges, said mat further comprising a profile which encloses said edges.

14. A safety contact mat as in claim 13 wherein said profile interlocks with said mat halves.

15. A safety contact mat as in claim 14 further comprising a spacer strip between the outer edges of respective said halves and an adhesive bonding together said mat halves, said spacer, and said profile.

16. A safety contact mat as in claim 13 wherein said profile comprises a ramp.

17. A safety contact mat as in claim 16 wherein said ramp forms a cable conduit.

18. A safety contact mat as in claim 13 wherein said profile is nitrile butadiene rubber.

19. A safety contact mat as in claim 13 wherein said profile is metal.

20. A construction kit for a safety contact mat, said kit comprising:

a pair of flat coextrudates each comprising a nonconductive elastomer, a conductive elastomer, and a conductive woven material enclosed between said nonconductive elastomer and said conductive elatomer, each said coextrudate having an outer edge;

a plurality of dielectric spacers for spacing the conductive elastomer of one coextrudate from the conductive elastomer of the other coextrudate;

a spacer strip for reception between the outer edges of respective coextrudates; and a connecting device having a pair of terminals for connecting to the conductive woven materials of respective said coextrudates.

21. A construction kit as in claim 20 further comprising an edge profile for reception on said outer edges when said edges are placed together with said spacer strip therebetween.

* * * * *